US009816248B2

(12) United States Patent
Martinez

(10) Patent No.: US 9,816,248 B2
(45) Date of Patent: Nov. 14, 2017

(54) SYSTEM AND METHOD FOR ASSISTED BUCKET LOAD OPERATION

(71) Applicant: Deere & Company, Moline, IL (US)

(72) Inventor: Ignacio Alonso Martinez, Saltillo (MX)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 14/943,992

(22) Filed: Nov. 17, 2015

(65) Prior Publication Data

US 2017/0121929 A1 May 4, 2017

Related U.S. Application Data

(60) Provisional application No. 62/249,052, filed on Oct. 30, 2015.

(51) Int. Cl.

| | |
|---|---|
| ***G06F 7/70*** | (2006.01) |
| ***E02F 3/43*** | (2006.01) |
| ***E02F 9/26*** | (2006.01) |
| ***E02F 9/24*** | (2006.01) |
| ***E02F 9/20*** | (2006.01) |
| *E02F 3/34* | (2006.01) |

(52) U.S. Cl.

CPC ..... *E02F 3/431* (2013.01); *E02F 9/2025* (2013.01); *E02F 9/24* (2013.01); *E02F 9/265* (2013.01); *E02F 3/34* (2013.01)

(58) Field of Classification Search

CPC . E02F 3/431; E02F 9/2025; E02F 9/24; E02F 9/265; E02F 3/34

USPC ..... 701/50; 37/348

See application file for complete search history.

(56) References Cited

U.S. PATENT DOCUMENTS

| | | | | |
|---|---|---|---|---|
| 5,974,352 | A | 10/1999 | Shull | |
| 6,246,939 | B1 | 6/2001 | Nozawa | |
| 6,618,659 | B1 * | 9/2003 | Berger | E02F 3/431 172/12 |
| 7,752,778 | B2 * | 7/2010 | Schoenmaker | E02F 3/439 37/348 |
| 9,441,348 | B1 * | 9/2016 | Alig | E02F 9/2228 |
| 2006/0042129 | A1 * | 3/2006 | Satake | E02F 9/2235 37/348 |

(Continued)

FOREIGN PATENT DOCUMENTS

WO 2015109392 A1 7/2015

OTHER PUBLICATIONS

John Deere, H Series Front Loader, Brochure, Admitted Prior Art.
European Search Report for Patent Application No. 16195070.4 1712 dated Mar. 20, 2017.

*Primary Examiner* — Shardul Patel
(74) *Attorney, Agent, or Firm* — Lorenz & Kopf, LLP

(57) ABSTRACT

A rollback control system and method are disclosed for a loader having a bucket movable between first and second positions by one or more hydraulic cylinders of a hydraulic circuit. The rollback control system includes a source of vehicle conditions data that indicates one or more observable conditions associated with the work vehicle. The rollback control system includes at least one controller that receives and processes the vehicle conditions data to determine a position of the bucket relative to a material. The at least one controller outputs one or more control signals to direct flow of hydraulic fluid to the hydraulic cylinders to move the bucket to the second position based on the determined position of the bucket.

19 Claims, 9 Drawing Sheets

(56) References Cited

U.S. PATENT DOCUMENTS

| | | | | |
|---|---|---|---|---|
| 2006/0245896 | A1 | 11/2006 | Alshaer et al. | |
| 2008/0263908 | A1* | 10/2008 | Schoenmaker ..... | E02F 3/434 37/348 |
| 2008/0263911 | A1* | 10/2008 | Shoenmaker ..... | E02F 9/264 37/348 |
| 2014/0119870 | A1 | 5/2014 | Martinez et al. | |
| 2014/0343800 | A1 | 11/2014 | Nelson et al. | |

* cited by examiner

SYSTEM AND METHOD FOR ASSISTED BUCKET LOAD OPERATION

CROSS-REFERENCE TO RELATED APPLICATION(S)

This application claims priority to U.S. provisional patent application Ser. No. 62/249,052, filed Oct. 30, 2015.

STATEMENT OF FEDERALLY SPONSORED RESEARCH OR DEVELOPMENT

Not applicable.

FIELD OF THE DISCLOSURE

This disclosure relates to work vehicles and assisting the loading operation of the work vehicle to increase the efficiency of the loading operation.

BACKGROUND OF THE DISCLOSURE

In the construction industry, various work machines, such as loaders, may be utilized in lifting and moving various materials. In certain examples, a loader may include a bucket pivotally coupled by a boom to a frame. One or more hydraulic cylinders are coupled to the boom and/or the bucket to move the bucket between positions relative to the frame.

Generally, in order to lift and move various materials, the loader may be moved towards the material such that the bucket is positioned within a certain amount of material. The movement of the loader is stopped, and then the bucket is moved to load the bucket with material. In certain instances the bucket may not be loaded fully, thereby reducing the efficiency of the loading operation.

SUMMARY OF THE DISCLOSURE

The disclosure provides a system and method for assisting the loading operation of a work vehicle, such as a loader, to increase the efficiency of the loading operation.

In one aspect the disclosure provides a rollback control system for a work vehicle having a bucket positioned by a boom assembly. The bucket is movable between a first position and a second position by one or more hydraulic cylinders of a hydraulic circuit to load the bucket with material. The rollback control system includes a source of vehicle conditions data that indicates one or more observable conditions associated with the work vehicle. The rollback control system includes at least one controller that receives and processes the vehicle conditions data to determine a position of the bucket relative to the material. The at least one controller outputs one or more control signals to direct flow of hydraulic fluid to the hydraulic cylinders to move the bucket to the second position based on the determined position of the bucket.

In another aspect the disclosure provides a rollback control method for a work vehicle having a bucket positioned by a boom assembly. The bucket is movable between a first position and a second position by hydraulic cylinders of a hydraulic circuit to load the bucket with material. The rollback control method includes receiving vehicle conditions data associated with one or more observable conditions of the work vehicle and processing the vehicle conditions data by at least one controller to determine a position of the bucket relative to the material. The method includes outputting one or more control signals with the at least one controller to direct flow of hydraulic fluid to the hydraulic cylinders to move the bucket to the second position based on the determined position of the bucket.

In yet another aspect the disclosure provides a rollback control system for a work vehicle having a bucket positioned by a boom assembly. The bucket is movable between a first position and a second position by hydraulic cylinders of a hydraulic circuit to load the bucket with material. The rollback control system includes a source of pressure data that indicates a pressure associated with the hydraulic circuit and a source of acceleration data associated with the boom assembly. The rollback control system includes at least one controller that receives and processes the pressure data and the acceleration data to determine a position of the bucket relative to the material. The at least one controller outputs one or more control signals to direct flow of hydraulic fluid to the hydraulic cylinders to move the bucket to the second position based on the determined position of the bucket.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
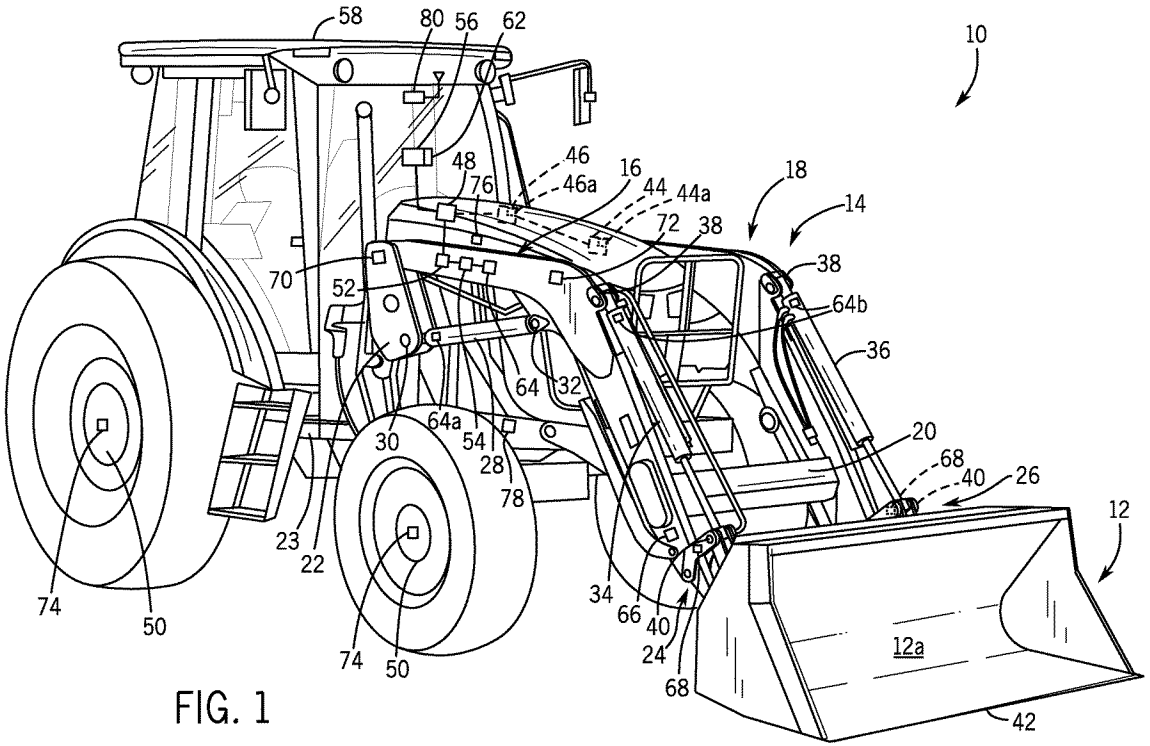
FIG. 1 is a perspective view of an example work vehicle in the form of a loader in which the disclosed rollback control system and method may be used.

The following describes one or more example embodiments of the disclosed system and method, as shown in the accompanying figures of the drawings described briefly above. Various modifications to the example embodiments may be contemplated by one of skill in the art.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of systems, and that the loader described herein is merely one example embodiment of the present disclosure.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

Generally, an end effector may be supported with respect to a work vehicle (or other work machine) by a boom assembly and the boom assembly may be moved by various actuators in order to accomplish tasks with the end effector. Discussion herein may sometimes focus on the example application of moving an end effector configured as a scoop or bucket for a loader, with actuators for moving the bucket generally configured as hydraulic cylinders. In other applications, other configurations are also possible. In some embodiments, for example, claws, grapples, or other devices may also be configured as movable end effectors. Likewise, work vehicles in some embodiments may be configured as excavators or other diggers, as forwarders, as skidders, or similar machines, or in various other ways.

The following describes one or more example implementations of the disclosed system for improving an efficiency of a loading operation by controlling movement or rollback of an end effector configured as a bucket, as shown in the accompanying figures of the drawings described briefly above. Generally, the disclosed control systems (and work vehicles in which they are implemented) provide for improved efficiency in a loading operation as compared to conventional systems by utilizing an inertia force to assist in loading the bucket with material. By utilizing the inertia force, the bucket of the work vehicle may be loaded or filled more fully in a shorter period of time, thereby increasing the efficiency of operation of the work vehicle.

The disclosed rollback control system may be used to receive operator commands for requesting assistance in a loading operation or for moving the bucket between a first, load position in which the bucket may be loaded with material to a second, rollback position in which the bucket retains the loaded material. As used herein, the phrase "rollback event" is used to denote the movement of the bucket from the first, load position to the second, rollback position. Upon receipt of the operator command, the control system determines to enable the rollback event based on the position of the bucket and/or boom assembly.

With the rollback event enabled, the control system determines whether the bucket is positioned within the material to be loaded into the bucket. The control system determines the bucket is positioned within the material for loading based in part on one or more work vehicle conditions exceeding a threshold. In certain embodiments, the control system determines whether one or more of a wheel speed, work vehicle speed, engine speed, work vehicle acceleration and/or work vehicle location exceed an associated predefined threshold. If one or more of these vehicle conditions exceed the associated threshold, the control system determines whether the acceleration of the boom assembly correlates with or corresponds to the one or more of the work vehicle conditions that exceed the predefined threshold. By comparing the boom assembly acceleration to the work vehicle condition that exceeds the predefined threshold, the control system may more accurately determine that the bucket is positioned within the material, and not digging a hole, for example.

Based upon the determination that the bucket is positioned within the material, the control system outputs one or more control signals or control commands to one or more hydraulic pumps and/or control valves in the hydraulic circuit of the work vehicle to drive or actuate the one or more hydraulic cylinders associated with the bucket to move the bucket into the second, rollback position. In certain embodiments, the control system may also output one or more control signals or commands to an engine control module associated with the work vehicle to increase a speed of the engine and/or output one or more control signals to a transmission control module to reduce a gear ratio to increase a torque available for the rollback.

By outputting the one or more control signals to the hydraulic pumps and/or control valves when the bucket is positioned in the material to be loaded, the inertia of the work vehicle and/or the material itself may be used to assist in loading the bucket. The assistance of the inertia force of the work vehicle and/or material more rapidly loads the bucket, and generally results in a fully loaded bucket, thereby improving the efficiency of the operation of the work vehicle.

As noted above, the disclosed rollback control system may be utilized with regard to various machines or work vehicles with load buckets, including loaders and other machines for lifting and moving various materials. Referring to FIG. 1, in some embodiments, the disclosed rollback control system may be used with a loader 10 to control a rollback of an end effector, which in this example is a scoop or bucket 12. By controlling the rollback of the bucket 12, an additional amount of material may be received within the bucket 12, thereby increasing the efficiency of the loading operation of the loader 10. It will be understood that the configuration of the loader 10 is presented as an example only. In this regard, the disclosed rollback control system may be implemented with a front loader removably coupled to a work vehicle, such as a tractor.

In the embodiment depicted, the bucket 12 is pivotally mounted to a boom assembly 14. In this example, the boom assembly 14 includes a first boom 16 and a second boom 18, which are interconnected via a crossbeam 20 to operate in parallel. Each of the first boom 16 and the second boom 18 are coupled to a frame portion 22 of a frame 23 of the loader 10 at a first end, and are coupled at a second end to the bucket 12 via a respective one of a first pivot linkage 24 and a second pivot linkage 26.

One or more hydraulic cylinders 28 are mounted to the frame portion 22 and to the boom assembly 14, such that the hydraulic cylinders 28 may be driven or actuated in order to move or raise the boom assembly 14 relative to the loader 10. Generally, the boom assembly 14 includes two hydraulic cylinders 28, one coupled between the frame portion 22 and the first boom 16; and one coupled between the frame portion 22 and the second boom 18. It should be noted, however, that the loader 10 may have any number of hydraulic cylinders, such as one, three, etc. Each of the hydraulic cylinders 28 includes an end mounted to the frame portion 22 at a pin 30 and an end mounted to the respective one of the first boom 16 and the second boom 18 at a pin 32. Upon activation of the hydraulic cylinders 28, the boom assembly 14 may be moved between various positions to elevate the boom assembly 14, and thus, the bucket 12 relative to the frame 23 of the loader 10.

One or more hydraulic cylinders 34 are mounted to the first boom 16 and the first pivot linkage 24, and one or more hydraulic cylinders 36 are mounted to the second boom 18 and the second pivot linkage 26. Generally, the loader 10 includes a single hydraulic cylinder 34, 36 associated with a respective one of the first boom 16 and the second boom 18. In this example, each of the hydraulic cylinders 34, 36 includes an end mounted to the respective one of the first boom 16 and the second boom 18 at a pin 38 and an end mounted to the respective one of the first pivot linkage 24 and the second pivot linkage 26 at a pin 40. Upon activation of the hydraulic cylinders 34, 36, the bucket 12 may be moved between various positions to pivot the bucket 12 relative to the boom assembly 14.

Thus, in the embodiment depicted, the bucket 12 is pivotable about the boom assembly 14 by the one or more hydraulic cylinders 34, 36. In other configurations, other movements of a bucket or end effector may be possible. Further, in some embodiments, a different number or configuration of hydraulic cylinders or other actuators may be used. Generally, the rollback control system disclosed herein may be applied with respect to any type of actuator capable of producing relative movement of a bucket.

Thus, it will be understood that the configuration of the bucket 12 is presented as an example only. In this regard, a hoist boom (e.g. the boom assembly 14) may be generally viewed as a boom that is pivotally attached to a vehicle frame, and that is also pivotally attached to an end effector. Similarly, a pivoting linkage (e.g., the first and second pivoting linkages 24, 26) may be generally viewed as a pin or similar feature effecting pivotal attachment of a receptacle (e.g. bucket 12) to a vehicle frame. In this light, a tilt actuator (e.g., the hydraulic cylinders 34, 36) may be generally viewed as an actuator for pivoting a receptacle with respect to a hoist boom, and the hoist actuator (e.g. the hydraulic cylinders 28) may be generally viewed as an actuator for pivoting a hoist boom with respect to a vehicle frame.

Figure 2:
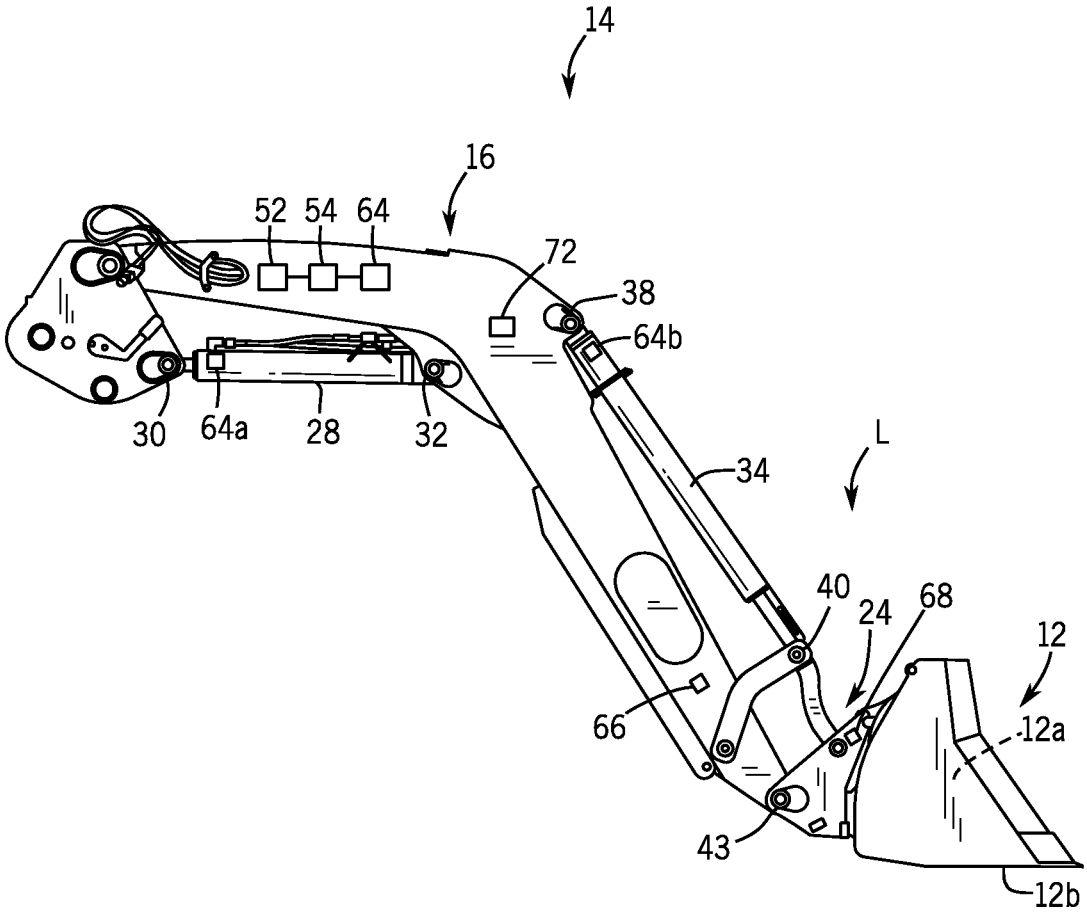
FIG. 2 is a side view of a boom assembly and bucket of the work vehicle of FIG. 1.

With additional reference to FIG. 2, the bucket 12 is coupled to the first pivot linkage 24 and the second pivot linkage 26 via one or more coupling pins 43. The coupling pins 43 cooperate with the first pivot linkage 24 and the second pivot linkage 26 to enable the movement of the bucket 12 upon activation of the hydraulic cylinders 34, 36. As will be discussed further herein, the bucket 12 is movable upon activation of the hydraulic cylinders 34, 36 between a first, load position L (FIGS. 2, 9A and 9B), a second, rollback position R (FIG. 9D) along with various positions in between. In the first, load position F, the bucket 12 is capable of receiving various materials. In the second, rollback position R, the bucket 12 is pivoted upward or relative to the horizontal by the actuation of the hydraulic cylinders 34, 36 such that the bucket 12 is loaded with and retains the various materials. The bucket 12 generally defines a receptacle 12*a* for the receipt of various materials, such as dirt, rocks, wet dirt, sand, hay, etc. In one example, the receptacle 12*a* may receive about 2.0 cubic yards of material to over about 5.0 cubic yards of material. The bucket 12 may include an elongated sidewall 12*b* on a bottommost edge to direct material into the receptacle 12*a*.

The loader 10 includes a source of propulsion, such as an engine 44. The engine 44 supplies power to a transmission 46. In one example, the engine 44 is an internal combustion engine, such as the diesel engine, that is controlled by an engine control module 44*a*. As will be discussed further herein, the engine control module 44*a* receives one or more control signals or control commands from a controller 48 to adjust a power output of the engine 44. It should be noted that the use of an internal combustion engine is merely an example, as the propulsion device can be a fuel cell, an electric motor, a hybrid-gas electric motor, etc., which is responsive to one or more control signals from the controller 48 to reduce a power output by the propulsion device.

The transmission 46 transfers the power from the engine 44 to a suitable driveline coupled to one or more driven wheels 50 (and tires) of the loader 10 to enable the loader 10 to move. As is known to one skilled in the art, the transmission 46 can include a suitable gear transmission, which can be operated in a variety of ranges containing one or more gears, including, but not limited to a park range, a neutral range, a reverse range, a drive range, a low range, etc. A current range of the transmission 46 may be provided by a transmission control module 46*a* in communication with the controller 48, or may be provided by a sensor that observes a range shifter or range selection unit associated with the transmission 46. As will be discussed, the controller 48 may output one or more control signals or control commands to the transmission 46 or transmission control module 46*a* to select the range for the operation of the transmission 46.

The loader 10 also includes one or more pumps 52, which may be driven by the engine 44 of the loader 10. Flow from the pumps 52 may be routed through various control valves 54 and various conduits (e.g., flexible hoses) in order to drive the hydraulic cylinders 28, 34, 36. Flow from the pumps 52 may also power various other components of the loader 10. The flow from the pumps 52 may be controlled in various ways (e.g., through control of the various control valves 54), in order to cause movement of the hydraulic cylinders 28, 34, 36, and thus, the bucket 12 relative to the loader 10. In this way, for example, a movement of the boom assembly 14 and/or bucket 12 between various positions relative to the frame 23 of the loader 10 may be implemented by various control signals to the pumps 52, control valves 54, and so on.

Generally, the controller 48 (or multiple controllers) may be provided, for control of various aspects of the operation of the loader 10, in general. The controller 48 (or others) may be configured as a computing device with associated processor devices and memory architectures, as a hardwired computing circuit (or circuits), as a programmable circuit, as a hydraulic, electrical or electro-hydraulic controller, or otherwise. As such, the controller 48 may be configured to execute various computational and control functionality with respect to the loader 10 (or other machinery). In some embodiments, the controller 48 may be configured to receive input signals in various formats (e.g., as hydraulic signals, voltage signals, current signals, and so on), and to output command signals in various formats (e.g., as hydraulic signals, voltage signals, current signals, mechanical movements, and so on). In some embodiments, the controller 48 (or a portion thereof) may be configured as an assembly of hydraulic components (e.g., valves, flow lines, pistons and cylinders, and so on), such that control of various devices (e.g., pumps or motors) may be effected with, and based upon, hydraulic, mechanical, or other signals and movements.

The controller 48 may be in electronic, hydraulic, mechanical, or other communication with various other systems or devices of the loader 10 (or other machinery). For example, the controller 48 may be in electronic or hydraulic communication with various actuators, sensors, and other devices within (or outside of) the loader 10, including various devices associated with the pumps 52, control valves 54, and so on. The controller 48 may communicate with other systems or devices (including other controllers) in various known ways, including via a CAN bus (not shown) of the loader 10, via wireless or hydraulic communication means, or otherwise. An example location for the controller 48 is depicted in FIG. 1. It will be understood, however, that other locations are possible including other locations on the loader 10, or various remote locations.

In some embodiments, the controller 48 may be configured to receive input commands and to interface with an operator via a human-machine interface 56, which may be disposed inside a cab 58 of the loader 10 for easy access by the operator. The human-machine interface 56 may be configured in a variety of ways. In some embodiments, the human-machine interface 56 may include one or more joysticks, various switches or levers, one or more buttons, a touchscreen interface that may be overlaid on a display 62, a keyboard, a speaker, a microphone associated with a speech recognition system, or various other human-machine interface devices.

Various sensors may also be provided to observe various conditions associated with the loader 10. In some embodiments, various sensors 64 (e.g., pressure, flow or other sensors) may be disposed near the pumps 52 and control valves 54, or elsewhere on the loader 10. For example, sensors 64 may include one or more pressure sensors that observe a pressure within the hydraulic circuit, such as a pressure associated with at least one of the one or more hydraulic cylinders 28, 34, 36. The sensors 64 may also observe a pressure associated with the hydraulic pumps 52. As a further example, one or more sensors 64*a* may be coupled to a respective one of the hydraulic cylinders 28 to observe a pressure within the hydraulic cylinders 28 and generate sensor signals based thereon. Further, one or more sensors 64*b* may be coupled to a respective one of the hydraulic cylinders 34, 36 to observe a pressure within the hydraulic cylinders 34, 36 and generate sensor signals based thereon.

In some embodiments, various sensors may be disposed near the bucket 12. For example, sensors 66 (e.g. inertial measurement sensors) may be coupled near the bucket 12 in order to observe or measure parameters including the acceleration of the boom assembly 14 near the bucket 12 and so on. Thus, the sensors 66 observe an acceleration of the boom assembly 14 near the bucket 12 and generate sensor signals thereon, which may indicate if the boom assembly 14 and/or bucket 12 is decelerating. In certain instances, the deceleration of the boom assembly 14 and/or bucket 12 indicates that the bucket 12 has contacted material, such as material for loading the bucket 12.

In some embodiments, various sensors 68 (e.g., rotary angular position sensor 68) may be configured to detect the angular orientation of the bucket 12 relative to the boom assembly 14, or detect various other indicators of the current orientation or position of the bucket 12. Thus, the sensors 68 generally include bucket position sensors that indicate a position of the bucket 12 relative to the boom assembly 14. Other sensors may also (or alternatively) be used. For example, a linear position or displacement sensors may be utilized in place of the rotary angular position sensors 68 to determine the length of the hydraulic cylinders 34, 36 relative to the boom assembly 14. In such a case, the detected linear position or displacement may provide alternative (or additional) indicators of the current position of the bucket 12.

Various sensors 70 (e.g., angular position sensor 70) may be configured to detect the angular orientation of the boom assembly 14 relative to the frame portion 22, or detect various other indicators of the current orientation or position of the boom assembly 14 relative to the frame 23 of the loader 10. Thus, the sensors 70 generally include boom position sensors that indicate a position of the boom assembly 14 relative to the frame 23 of the loader 10. Other sensors may also (or alternatively) be used. For example, a linear position or displacement sensors may be utilized in place of the angular position sensors 70 to determine the length of the hydraulic cylinders 28 relative to the frame portion 22. In such a case, the detected linear position or displacement may provide alternative (or additional) indicators of the current position of the boom assembly 14.

Various sensors 72-78 may also be disposed on or near the frame 23 of the loader 10 in order to measure various parameters associated with the loader 10. In one example, sensor 72 observes a speed of the loader 10 and generates sensor signals based thereon. Sensor 74 observes a speed of one or more of the wheels 50 of the loader 10 and generates sensor signals based thereon. Sensor 76 observes a speed of the engine 44 of the loader 10 (e.g. a tachometer) and generates sensor signals based thereon. Sensor 78 observes an acceleration of the frame 23 of the loader 10, and generates sensor signals based thereon.

In certain embodiments, one or more location-sensing devices may also be included on or associated with the loader 10. For example, a GPS device 80 may use GPS technology to detect the location of the loader 10 at regular intervals (e.g., during a loading operation). The detected locations may then be communicated via various known means to the controller 48 associated with the loader 10. In certain embodiments, the detected locations may additionally (or alternatively) be communicated to one or more remote systems.

The various components noted above (or others) may be utilized to control movement of the bucket 12 via control of the movement of the one or more hydraulic cylinders 28, 34, 36. Accordingly, these components may be viewed as forming part of the rollback control system for the loader 10. Each of the sensors 64-78 and the GPS device 80 may be in communication with the controller 48 via a suitable communication architecture.

In various embodiments, the controller 48 outputs one or more control signals or control commands to the hydraulic cylinders 28, 34, 36 associated with the loader 10 based on one or more of the sensor signals received from the sensors 64-78, location data from the GPS device 80 and input received from the human-machine interface 56, and further based on the rollback control system and method of the present disclosure. The controller 48 outputs the one or more control signals or control commands to the pumps 52 and/or control valves 54 associated with hydraulic cylinders 34, 36 to move the bucket 12 into the second, rollback position R based on one or more of the sensor signals received from the sensors 64-78, location data from the GPS device 80, and input received from the human-machine interface 56. By controlling the movement of the bucket 12 into the second, rollback position R based in part on the sensor signals, the loading efficiency of the bucket 12 is increased. In some embodiments, the controller 48 also outputs the one or more control signals or control commands to the engine control module 44*a* to increase a speed of the engine 44 based on one or more of the sensor signals received from the sensors 64-78, location data from the GPS device 80, and input received from the human-machine interface 56. The controller 48 outputs the one or more control signals or control commands to the transmission control module 46*a* to reduce the gear ratio of the transmission 46 based on one or more of the sensor signals received from the sensors 64-78, location data from the GPS device 80 and input received from the human-machine interface 56. The increase in engine speed and the reduction in the gear ratio increases the available torque for the loader 10, which also increases the efficiency of the loading operation.

Figure 3:
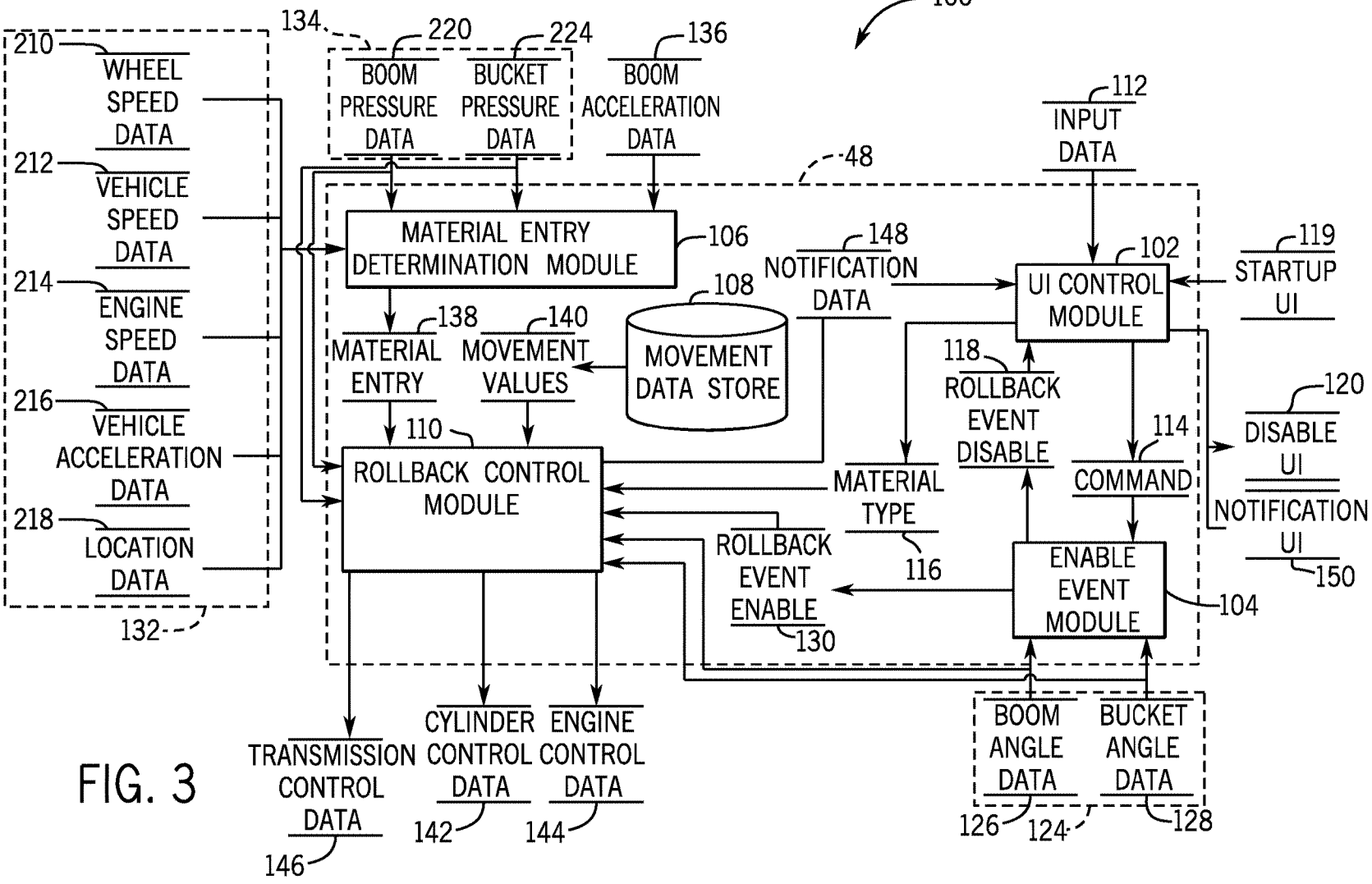
FIG. 3 is a dataflow diagram illustrating an example rollback control system in accordance with various embodiments.

Referring now also to FIG. 3, a dataflow diagram illustrates various embodiments of a rollback control system 100 for the loader 10, which may be embedded within the controller 48. Various embodiments of the rollback control system 100 according to the present disclosure can include any number of sub-modules embedded within the controller 48. As can be appreciated, the sub-modules shown in FIG. 2 can be combined and/or further partitioned to similarly control the hydraulic cylinders 34, 36 for moving the bucket 12 between the first, load position L and the second, rollback position R, and to control the speed of the engine 44 of the loader 10 via the engine control module 44*a* and/or the gear ratio of the transmission 46 via the transmission control module 46*a*. Inputs to the rollback control system 100 are received from the sensors 64-78 (FIG. 1), received from the GPS device 80 (FIG. 1), received from the human-machine interface 56 (FIG. 1), received from other control modules (not shown) associated with the loader 10, and/or determined/modeled by other sub-modules (not shown) within the controller 48. In various embodiments, the controller 48 includes a user interface (UI) control module 102, an enable event module 104, a material entry determination module 106, a movement data store 108 and a rollback control module 110.

The UI control module 102 receives input data 112 from the human-machine interface 56. The input data 112 includes a command 114 to initiate an assisted movement of the bucket 12 into the second, rollback position R to improve the efficiency of the loading operation. In certain embodiments, the input data 112 includes a type of material or material type 116 that will load the bucket 12, including, but not limited to dirt, rocks, wet dirt, sand, hay, etc. The material type 116 may be input to the UI control module 102 via an operator's interaction with a start-up user interface 119, which may be displayed on the display 62 of the human-machine interface 56. The start-up user interface 119 may include one or more graphical or textual interfaces for receipt of user input, such as buttons, toggles, drop-down menus, selectable icons, etc., which enable the selection of the type of material and so on.

The UI control module 102 interprets the input data 112 and sets the command 114 for the enable event module 104. The UI control module 102 also interprets the input data 112, which may include input data to the start-up user interface 119, and sets the material type 116 for the rollback control module 110.

The UI control module 102 also receives as input a rollback event disable 118 from the enable event module 104. The rollback event disable 118 indicates that the movement of the bucket 12 to the second, rollback position R has been disabled. Based on the receipt of the rollback event disable 118, the UI control module 102 outputs a disable user interface 120. The disable user interface 120 may be a pop-up graphical user interface or other graphical user interface for display on the display 62 that indicates that the bucket 12 is disabled from moving to the second, rollback position R. For example, the disable user interface 120 may include a textual message such as "Unable to Assist in Rollback," which may be displayed on the display 62. The disable user interface 120 may also include a suitable graphic, such as an icon of the loader 10 with the bucket 12 in red (or another suitable warning color) for example. In certain instances, the movement of the bucket 12 to the second, rollback position R may be disabled when the bucket 12 is not in the first, load position F, for example.

The UI control module 102 also receives as input notification data 148 from the rollback control module 110. The notification data 148 indicates that the hydraulic pressure for one or more of the hydraulic cylinders 28, 34, 36 has exceeded a predefined hydraulic pressure threshold. Based on the receipt of the notification data 148, the UI control module 102 outputs a notification user interface 150. The notification user interface 150 may be a pop-up graphical user interface or other graphical user interface for display on the display 62 that indicates that the hydraulic pressure in one or more of the hydraulic cylinders 28, 34, 36 exceeds a predefined hydraulic pressure threshold. For example, the notification user interface 150 may include a textual message such as "Warning: Check Hydraulic Pressure," which may be displayed on the display 62. The notification user interface 150 may also include a suitable graphic, such as an icon of the loader 10 with one or more of the hydraulic cylinders 28, 34, 36 in red (or another suitable warning color) for example.

The enable event module 104 receives as input the command 114. The enable event module 104 also receives as input angle sensor data 124. In one example, the angle sensor data 124 includes boom angle data 126 and bucket angle data 128. The boom angle data 126 has sensor data or sensor signals from the sensors 70, which indicate the angular orientation of the boom assembly 14 relative to the frame portion 22. The bucket angle data 128 has sensor data or sensor signals from the sensors 68, which indicate the angular orientation of the bucket 12 relative to the boom assembly 14.

Based on the boom angle data 126 and the bucket angle data 128, the enable event module 104 determines whether to enable a movement of the bucket 12 to the second, rollback position R. In one example, the enable event module 104 determines to enable the movement of the bucket 12 into the second, rollback position R based on the boom angle data 126 and the bucket angle data 128 indicating that the bucket 12 is in the first, load position L such that the bucket 12 may be loaded with material. In certain embodiments, the enable event module 104 determines the location of the bucket 12 as in the first, load position L based on a comparison of the boom angle data 126 and the bucket angle data 128 to known values for the boom angle data 126 and the bucket angle data 128 when the bucket 12 is in the first, load position F. These known values may be stored in memory and set by the factory as default values. Alternatively, these known values may be retrieved from a data store (not shown) associated with the enable event module 104, which includes a look-up table from which the enable event module 104 may query to determine whether the bucket 12 is in the first, load position L based on the boom angle data 126 and the bucket angle data 128.

Based on the determination, the enable event module 104 sets either rollback event enable 130 for the rollback control module 110 or the rollback event disable 118 for the UI control module 102. The rollback event enable 130 indicates that the movement of the bucket 12 to the second, rollback position R has been enabled based on the determination that the bucket 12 is in the first, load position F.

The material entry determination module 106 receives as input vehicle conditions data 132, hydraulic pressure data 134 and boom acceleration data 136. Based on these inputs, the material entry determination module 106 determines a position of the bucket 12 relative to the material for loading the bucket 12. Stated another way, the material entry determination module 106 determines whether the bucket 12 is positioned in the material for loading the bucket 12, and based on this determination sets material entry 138 for the rollback control module 110.

Figure 4:
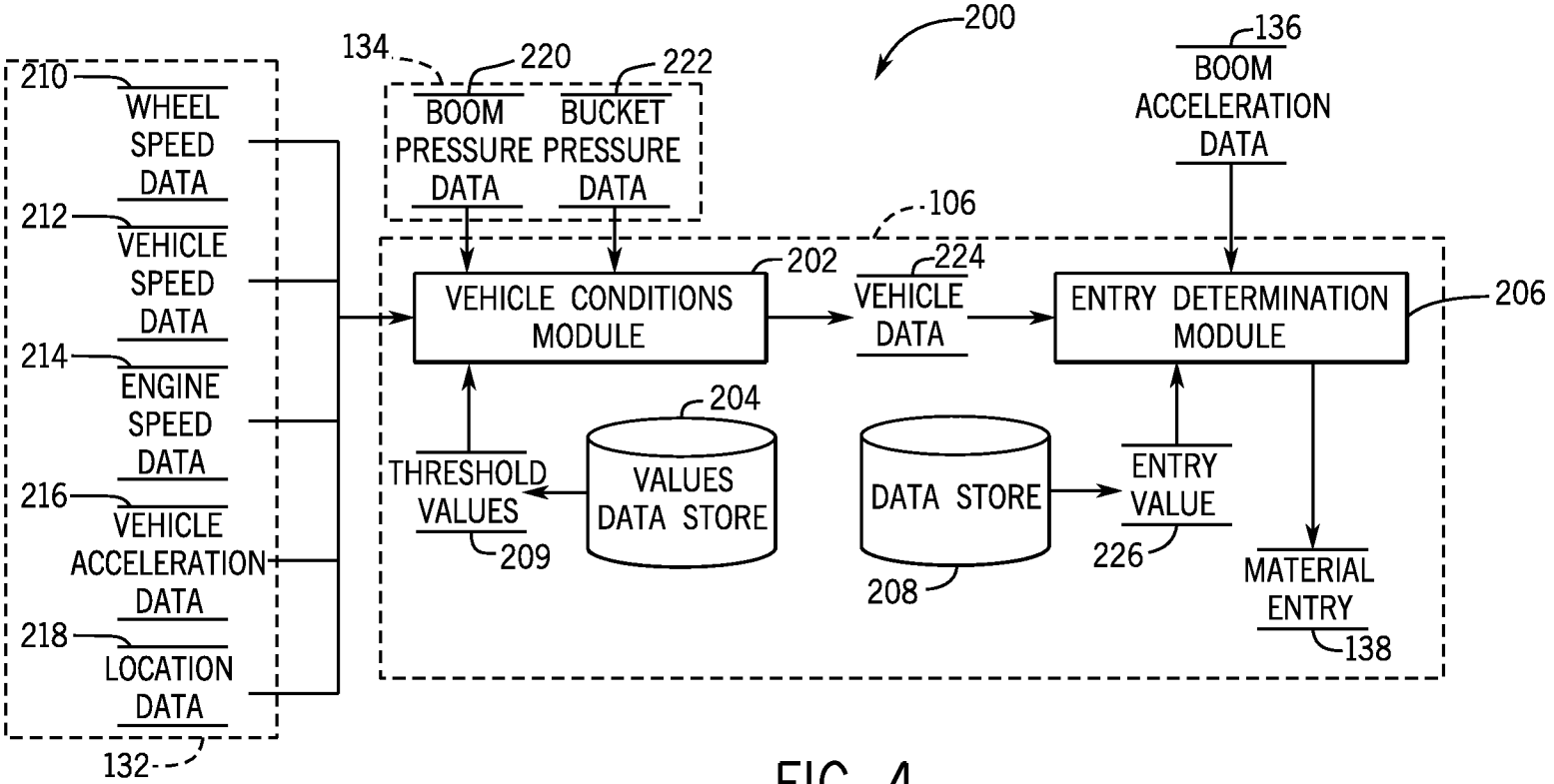
FIG. 4 is a dataflow diagram illustrating an example material determination system in accordance with various embodiments.

In this regard, with reference to FIG. 4, and with continued reference to FIGS. 1 and 2, a dataflow diagram illustrates various embodiments of a material determination system 200 for the loader 10, which may be embedded within the material entry determination module 106. Various embodiments of the material determination system 200 according to the present disclosure can include any number of sub-modules embedded within the material entry determination module 106. As can be appreciated, the sub-modules shown in FIG. 4 can be combined and/or further partitioned to similarly determine a position of the bucket 12 relative to the material for loading the bucket 12. Inputs to the material determination system 200 are received from the sensors 64-78 (FIG. 1), received from the GPS device 80 (FIG. 1), received from other control modules (not shown) associated with the loader 10, and/or determined/modeled by other sub-modules (not shown) within the controller 48. In various embodiments, the material entry determination module 106 includes a vehicle conditions module 202, a values data store 204, an entry determination module 206 and a data store 208.

The values data store 204 stores one or more values for each of the vehicle conditions and the hydraulic pressure. In other words, the values data store 204 stores one or more threshold values 209 associated with each of the vehicle condition data and the hydraulic pressure data that once exceeded indicate that the bucket 12 is likely positioned in the material. The threshold values 209 may be based on calibration or experimental data, which are predefined or factory set (e.g. default values). Generally, the values data store 204 stores the threshold value 209 associated with each of the vehicle conditions data 132 and the hydraulic pressure data 134. It should be noted, however, that the values data store 204 may also include one or more tables (e.g., lookup tables or interpolation tables) for the determination of whether the bucket 12 is positioned in the material based on one or more of the vehicle conditions data 132 and the hydraulic pressure data 134.

The vehicle conditions module 202 receives as input the vehicle conditions data 132. In one example, the vehicle conditions data 132 includes wheel speed data 210, vehicle speed data 212, engine speed data 214, vehicle acceleration data 216 and location data 218. The wheel speed data 210 has sensor data or sensor signals from the sensors 74, which indicate a speed of one or more of the wheels 50 of the loader 10. The vehicle speed data 212 has sensor data or sensor signals from the sensors 72, which indicate a speed of the loader 10. The engine speed data 214 has sensor data or sensor signals from the sensors 76, which indicate a speed of the engine 44. The vehicle acceleration data 216 has sensor data or sensor signals from the sensors 78, which indicate an acceleration of the frame 23 of the loader 10. The location data 218 has data from the GPS device 80, which indicates a current geographical location for the loader 10.

The vehicle conditions module 202 interprets the wheel speed data 210, vehicle speed data 212, engine speed data 214, vehicle acceleration data 216 and location data 218 and determines the speed of the wheels 50, the speed of the loader 10, the speed of the engine 44, the acceleration of the loader 10 and the location of the loader 10. In certain embodiments, the vehicle conditions module 202 also determines a change in one or more of these determined values over a predefined time period. For example, the vehicle conditions module 202 determines a change in the speed of the wheels 50 over a predefined period of time, a change in the speed of the loader 10 over the predefined period of time, a change in the speed of the engine 44 over the predetermined period of time, a change in the acceleration of the loader 10 over the predetermined period of time and a distance traveled by the loader 10 based on a difference between the geographical locations of the loader 10 over the predefined time period, for example.

The vehicle conditions module 202 also receives as input the hydraulic pressure data 134. In one example, the hydraulic pressure data 134 includes boom pressure data 220 and bucket pressure data 222. The boom pressure data 220 has sensor data or sensor signals from the sensors 64, such as sensors 64*a*, which indicate a pressure within the hydraulic circuit, such as a pressure associated with the hydraulic cylinders 28. The bucket pressure data 222 has sensor data or sensor signals from the sensors 64, such as sensors 64*b*, which indicate a pressure within the hydraulic circuit, such as a pressure associated with the hydraulic cylinders 34, 36.

Based on the vehicle conditions data 132 and the hydraulic pressure data 134, the vehicle conditions module 202 retrieves the threshold values 209 that are associated with each of the wheel speed data 210, the vehicle speed data 212, the engine speed data 214, the vehicle acceleration data 216, the location data 218, the boom pressure data 220 and the bucket pressure data 222. The vehicle conditions module 202 compares the vehicle conditions data 132 and the hydraulic pressure data 134 to the retrieved associated threshold values 209. If one or more of the vehicle conditions data 132 and/or the hydraulic pressure data 134 are greater than or exceed the associated threshold value 209, the vehicle conditions module 202 sets vehicle data 224 for the entry determination module 206. The vehicle data 224 indicates which of the vehicle conditions data 132 and/or hydraulic pressure data 134 has exceeded the threshold, and may include the determined value for the vehicle conditions data 132 and/or the hydraulic pressure data 134.

As an example, the vehicle conditions module 202 compares the determined change in the speed of the wheels 50 to the threshold value 209 associated with wheel speed. If the change in the speed of the wheels 50 exceeds the threshold value 209, the vehicle conditions module 202 sets the vehicle data 224. Generally, the speed of the wheels 50 decreases upon entry into a material.

As a further example, the vehicle conditions module 202 compares the determined change in the speed of the loader 10 to the threshold value 209 associated with vehicle speed. If the change in the speed of the loader 10 exceeds the threshold value 209, the vehicle conditions module 202 sets the vehicle data 224. Generally, the speed of the loader 10 decreases upon entry into a material.

In another example, the vehicle conditions module 202 compares the determined change in the speed of the engine 44 to the threshold value 209 associated with engine speed. If the change in the speed of the engine 44 exceeds the threshold value 209, the vehicle conditions module 202 sets the vehicle data 224. Generally, the speed of the engine 44 increases upon entry into a material.

The vehicle conditions module 202 compares the determined change in the acceleration of the loader 10 to the threshold value 209 associated with vehicle acceleration. If the change in the acceleration of the loader 10 exceeds the threshold value 209, the vehicle conditions module 202 sets the vehicle data 224. Generally, the acceleration of the loader 10 decreases upon entry into a material.

The vehicle conditions module 202 compares the determined distance traveled by the loader 10 to the threshold value 209 associated with the location of the loader 10. If the distance traveled by the loader 10 exceeds the threshold value 209, the vehicle conditions module 202 sets the vehicle data 224. Generally, the distance traveled by the loader 10 decreases upon entry into a material.

As a further example, the vehicle conditions module 202 compares the boom pressure data 220 to the threshold value 209 associated with the hydraulic pressure of the hydraulic cylinders 28. If the boom pressure data 220 exceeds the threshold value 209, the vehicle conditions module 202 sets the vehicle data 224. Generally, the boom pressure data 220 increases upon entry into a material.

The vehicle conditions module 202 compares the bucket pressure data 222 to the threshold value 209 associated with the hydraulic pressure of the hydraulic cylinders 34, 36. If the bucket pressure data 222 exceeds the threshold value 209, the vehicle conditions module 202 sets the vehicle data 224. Generally, the bucket pressure data 222 increases upon entry into a material.

Figure 9A:
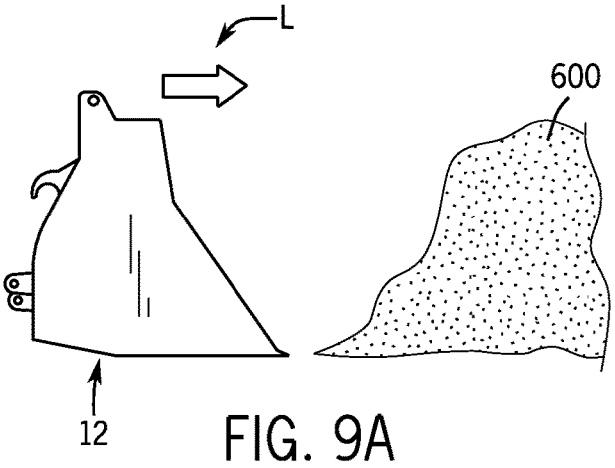
FIGS. 9A-9D are simplified partial side views illustrating the rollback control system and method being implemented for a loading operation of a bucket associated with the work vehicle of FIG. 1.

The data store 208 stores one or more tables (e.g., lookup tables) that indicate whether the bucket 12 is positioned into material based on the vehicle data 224 and an acceleration of the boom assembly 14. In other words, the data store 208 stores one or more tables that provide an entry value 226 that indicates whether the bucket 12 is positioned into the material. The entry value 226 may include true or false. The one or more tables may be calibration tables, which are acquired based on experimental data. In various embodiments, the tables may be interpolation tables that are defined by one or more indexes. As an example, one or more tables can be indexed by various parameters such as, but not limited to, vehicle condition (e.g. wheel speed, vehicle speed, engine speed, vehicle acceleration, distance traveled) and acceleration of the boom assembly 14, to provide the entry value 226. Generally, the one or more tables correlate the vehicle data 224 to the acceleration of the boom assembly 14 based on calibration or experimental data to provide a more accurate estimation that the bucket 12 is positioned within material (e.g. a true entry value 226; as illustrated in FIG. 9A) or that the bucket 12 is not positioned within material (e.g. a false entry value 226).

The entry determination module 206 receives as input the vehicle data 224 and boom acceleration data 136. The boom acceleration data 136 has sensor data or sensor signals from the sensors 66, which indicate the acceleration of the boom assembly 14 near the bucket 12. Based on the vehicle data 224 and the boom acceleration data 136, the entry determination module 206 queries the data store 208 for the entry value 226. Based on the entry value 226, the entry determination module 206 sets the material entry 138 for the rollback control module 110 (FIG. 3).

With reference back to FIG. 3, the movement data store 108 stores one or more tables (e.g., lookup tables) that indicate a movement of the various hydraulic cylinders 34, 36 based on boom angle data 126 from the sensors 66, the bucket angle data 128 from the sensors 64, and the material type 116. In other words, the movement data store 108 stores one or more tables that provide an amount of hydraulic fluid to be applied to the hydraulic cylinders 34, 36 from the pumps 52 and/or the control valves 54 based on various positions of the boom assembly 14, various positions of the bucket 12 and the type of material for the loading operation of the bucket 12. The one or more tables include calibration tables, which are acquired based on experimental data. In various embodiments, the tables may be interpolation tables that are defined by one or more indexes. A movement value 140 provided by at least one of the tables indicates an amount of hydraulic fluid to be applied to the hydraulic cylinders 34, 36 by the pumps 52 and/or the control valves 54 to move the bucket 12 to the second, rollback position R to load the bucket 12 (FIG. 9D) based on the angle of the boom assembly 14, the angle of the bucket 12 and the type of material. As an example, one or more tables can be indexed by various parameters such as, but not limited to, boom assembly angle, bucket angle and material type, to provide the movement value 140.

It should be noted that in certain embodiments, the movement data store 108 may be configured differently. In this regard, the movement data store 108 may not include the movement value 140 based on material type 116. In this example, the movement data store 108 may include a movement value 140 based on the various positions of the boom assembly 14 and the various positions of the bucket 12.

Moreover, in certain embodiments, a movement value 140 may be predefined or factory set (e.g. default values) that are stored in a memory associated with the controller 48 for the amount of hydraulic fluid to be applied to the hydraulic cylinders 34, 36 from the pumps 52 and/or the control valves 54 to move the bucket 12 to the second, rollback position R. In this example, the movement value 140 may be modified by the rollback control module 110 based on boom angle data 126 from the sensors 66. For example, if the rollback control module 110 determines the angle of the boom assembly 14 exceeds a predefined boom angle threshold, the predefined movement value 140 may be reduced by a predefined percentage. By reducing the predefined movement value 140 by a predefined percentage when the boom angle data 126 exceeds the predefined boom angle threshold, the risk of the material spilling out of the bucket 12 is reduced.

In this example, the rollback control module 110 receives as input the material entry 138 and the rollback event enable 130. Based on the rollback event enable 130 and the material entry 138 indicating that the bucket 12 is positioned in the material, the rollback control module 110 receives as input the boom angle data 126, the bucket angle data 128 and the material type 116. Based on the boom angle data 126, the bucket angle data 128 and the material type 116, the rollback control module 110 queries the movement data store 108 and retrieves the movement value 140. Based on the movement value 140, the rollback control module 110 outputs cylinder control data 142. The cylinder control data 142 includes one or more control signals for the pumps 52 and/or control valves 54 to actuate the hydraulic cylinders 34, 36 to move the bucket 12 to the second, rollback position R.

In certain embodiments, based on the rollback event enable 130 and the material entry 138, the rollback control module 110 outputs engine control data 144 and transmission control data 146 to increase the torque available for moving the bucket 12 into the second, rollback position R. The engine control data 144 includes one or more control signals or control commands for the engine control module 44*a* to increase the speed of the engine 44 (i.e. revolutions per minute (rpm)). The transmission control data 146 includes one or more control signals or control commands for the transmission control module 46*a* to shift the transmission 46 into the lowest available gear ratio.

In certain embodiments, the rollback control module 110 may also receive as input the hydraulic pressure data 134, including the boom pressure data 220 and/or the bucket pressure data 222. The rollback control module 110 may compare the received hydraulic pressure data 134 to determine if one or more of the boom pressure data 220 and the bucket pressure data 222 exceed a predetermined hydraulic pressure threshold. If one or more of the boom pressure data 220 and the bucket pressure data 222 exceeds the predetermined hydraulic pressure threshold, the rollback control module 110 sets notification data 148 for the UI control module 102. The rollback control module 110 may also output cylinder control data 142 based on the notification data 148 to reduce the amount of hydraulic fluid supplied by the pumps 52 and/or control valves 54 to the hydraulic cylinders 34, 36. By monitoring the hydraulic pressure data 134, the rollback control module 110 may reduce the hydraulic fluid supplied to the hydraulic cylinders 34, 36 in instances where the material for the loading operation may be imparting a greater inertial force onto the bucket 12.

Referring now also to FIGS. 5-8, a flowchart illustrates a control method 300 that may be performed by the controller 48 of FIGS. 1-4 in accordance with the present disclosure. As can be appreciated in light of the disclosure, the order of operation within the method is not limited to the sequential execution as illustrated in FIGS. 5-8, but may be performed in one or more varying orders as applicable and in accordance with the present disclosure.

In various embodiments, the method may be scheduled to run based on predetermined events, and/or can run based on the receipt of input data 112.

Figure 5:
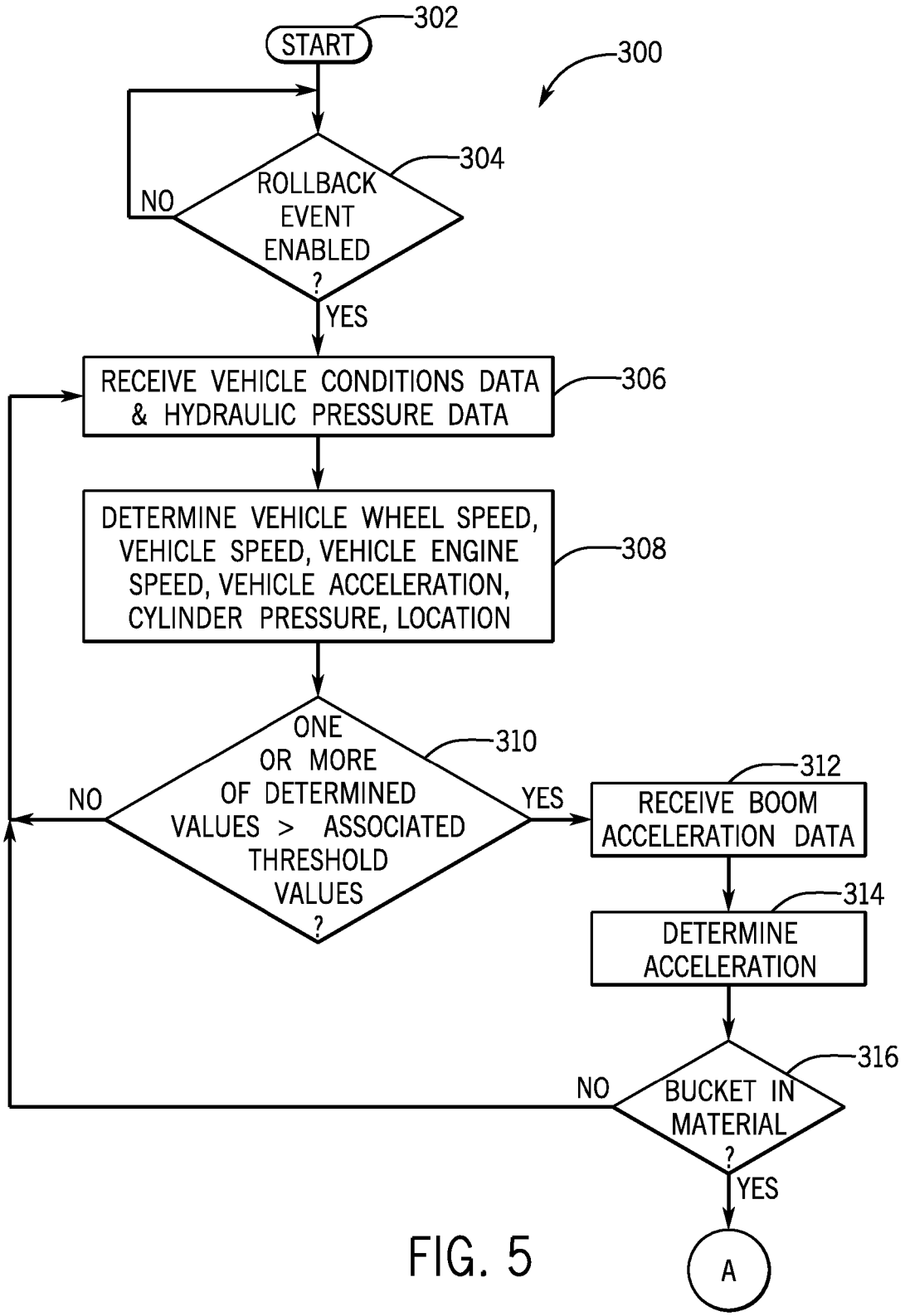
FIG. 5 is a flowchart illustrating an example control method of the disclosed rollback control system of FIG. 1 in accordance with various embodiments.
Figure 7:
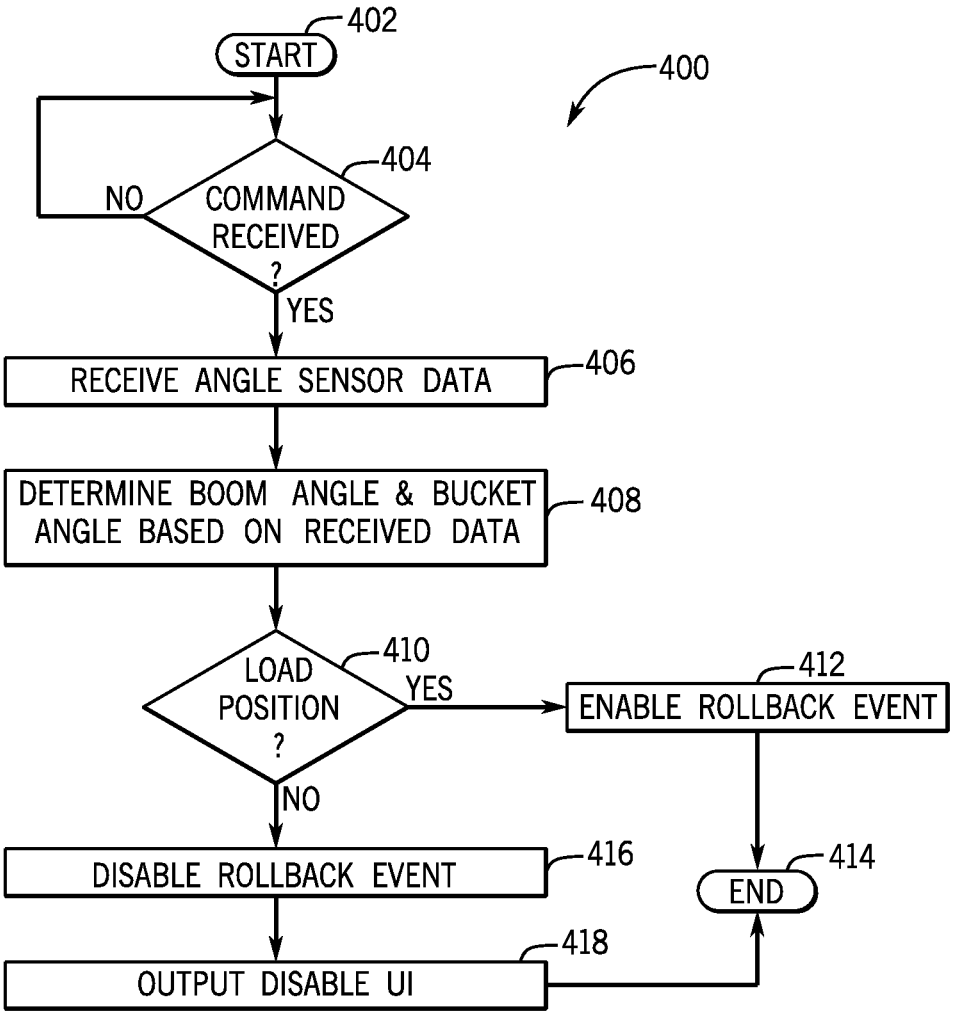
FIG. 7 is a flowchart illustrating an example control method for determining to enable a rollback event in accordance with various embodiments.

In one example, with reference to FIG. 5, the method begins at 302. At 304, the method determines whether a rollback event has been enabled. In one example, with reference to FIG. 7, a flowchart illustrates a control method 400 for determining to enable a movement of the bucket 12 to the second, rollback position R (i.e. a rollback event) that may be performed by the controller 48 of FIGS. 1-4 in accordance with the present disclosure. With reference to FIG. 7, the method starts at 402. At 404, the method determines whether the input data 112 has been received, which provides a command for an assisted movement of the bucket 12 into the second, rollback position R. At 406, the method receives the angle sensor data 124, which includes the boom angle data 126 from the sensors 70 and the bucket angle data 128 from the sensors 68.

At 408, the method determines the angle of the boom assembly 14 relative to the loader 10 and the angle of the bucket 12 relative to the boom assembly 14. At 410, the method determines whether the bucket 12 is in the first, load position L based on the angle sensor data 124. In one example, the method determines that the bucket 12 is in the first, load position by comparing the angle sensor data 124 to known values (e.g. default values) for the angle of the boom assembly 14 and the angle of the bucket 12 in the first, load position F. If the bucket 12 is determined to be in the first, load position F, the method enables the rollback event at 412 and ends at 414. Otherwise, if the bucket 12 is not in the first, load position F, the method disables the rollback event at 416 and outputs the disable user interface 120 at 418. The method ends at 414.

With reference back to FIG. 5, if the rollback event is enabled, the method proceeds to 306. Otherwise, the method continues to wait for the rollback event to be enabled at 304. At 306, the method receives vehicle conditions data 132 from sensors 72-78, the GPS device 80 and hydraulic pressure data 134 from sensors 64. At 308, the method determines the speed of the wheels 50 and/or a change in the speed of the wheels 50 based on the wheel speed data 210; determines the speed of the loader 10 and/or a change in the speed of the loader 10 based on the vehicle speed data 212; determines the speed of the engine 44 and/or a change in the speed of the engine 44 based on the engine speed data 214; determines the acceleration of the loader 10 and/or a change in the acceleration of the loader 10 based on the vehicle acceleration data 216; determines a location or a distance traveled by the loader 10 based on the location data 218; and determines the hydraulic pressure in the hydraulic cylinders 28 and hydraulic cylinders 34, 36.

At 310, the method determines whether one or more of the values determined at block 308 exceed the associated threshold value 209 retrieved from the values data store 204. If one or more of the determined values from block 308 exceed the associated threshold value 209, the method proceeds to 312. Otherwise, the method loops to 306.

At 312, the method receives the boom acceleration data 136 from the sensors 66. At 314, the method determines the acceleration of the boom assembly 14. At 316, the method determines whether the bucket 12 is in the material. In one example, the method queries the data store 208 and retrieves the entry value 226 (e.g. true or false) based on the determined acceleration of the boom assembly 14 and the one or more determined values that exceed the associated threshold value 209 (from block 310). If true, the method proceeds to A on FIG. 6. If false, the method loops to 306.

Figure 6:
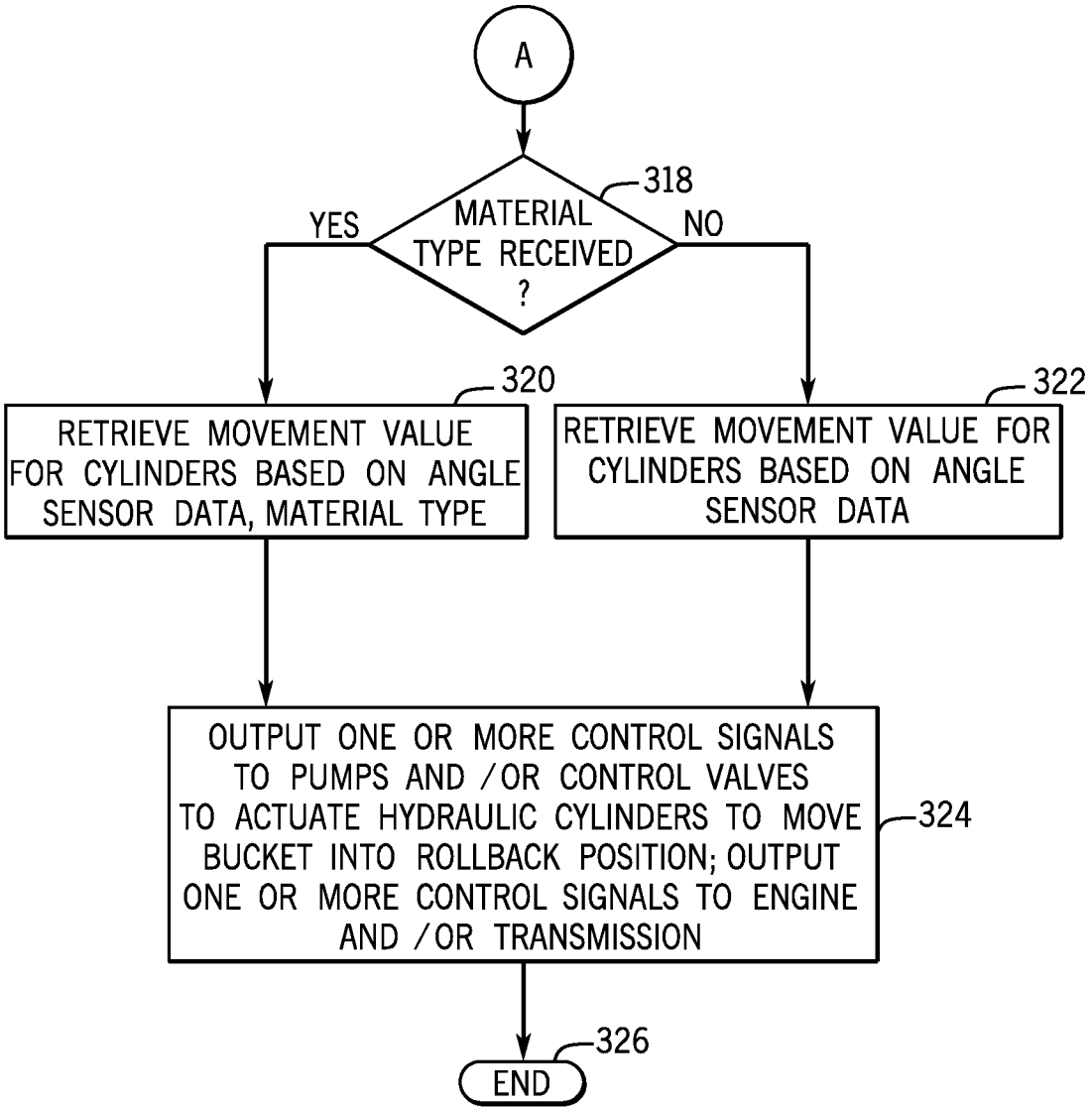
FIG. 6 is a continuation of the flowchart of FIG. 5.

With reference to FIG. 6, at 318, the method determines whether the material type 116 has been received via operator input to the human-machine interface 56. If the type of material for the loading operation has been received, the method proceeds to 320. Otherwise, at 322, the method retrieves the movement value 140 for the hydraulic cylinders 34, 36 based on the boom angle data 126 and the bucket angle data 128. At 324, the method outputs one or more control signals to the pumps 52 and/or control valves 54 to actuate the hydraulic cylinders 34, 36 to move the bucket 12 to the second, rollback position R based on the movement value 140. Optionally at 324, the method also outputs one or more control signals to the engine control module 44*a* to increase the speed of the engine 44 and/or outputs one or more control signals to the transmission control module 46*a* to shift the transmission 46 to the lowest available gear ratio. The method ends at 326.

Otherwise, at 320, the method retrieves the movement value 140 for the hydraulic cylinders 34, 36 based on the boom angle data 126, the bucket angle data 128 and the material type 116. The method proceeds to 324.

In certain embodiments, the method may not perform blocks 318-326. For example, in the example of a predefined or factory set movement value 140, the method may determine whether the boom angle data 126 indicates that the boom assembly 14 is at an angle greater than the predefined boom angle threshold. If true, the method may reduce the predefined movement value by a percentage and output the one or more control signals to the pumps 52 and/or control valves 54 to actuate the hydraulic cylinders 34, 36 based on this reduced movement value. If false, the method may output the predefined movement value to the pumps 52 and/or control valves 54 to actuate the hydraulic cylinders 34, 36.

Figure 8:
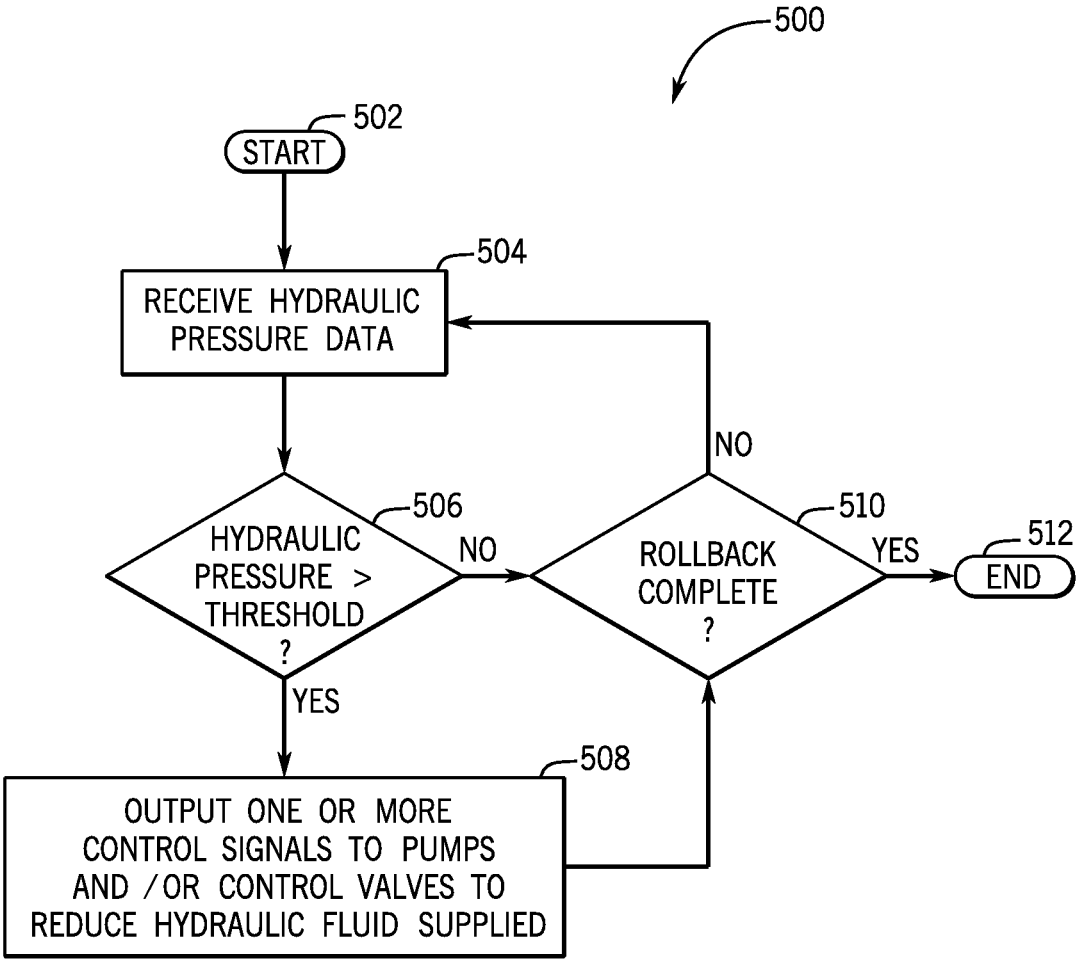
FIG. 8 is a flowchart illustrating an example control method for monitoring a hydraulic pressure in accordance with various embodiments.

With reference to FIG. 8, a flowchart illustrates a control method 500 for monitoring a hydraulic pressure during a rollback event that may be performed by the controller 48 of FIGS. 1-4 in accordance with the present disclosure. The method may run upon the rollback event being enabled at 304 on FIG. 5, however, the control method 500 may run at any desired point during the operation of the loader 10.

With reference to FIG. 8, the method begins at 502. At 504, the method receives the hydraulic pressure data 134 from the sensors 64, which includes the boom pressure data 220 and the bucket pressure data 222. At 506, the method determines whether the hydraulic pressure exceeds a predefined hydraulic pressure threshold. If the hydraulic pressure exceeds the predefined hydraulic pressure threshold, at 508, the method outputs one or more control signals to the pumps 52 and/or control valves 54 to reduce the amount of hydraulic fluid supplied to the hydraulic cylinders 28, 34, 36. At 510, the method determines whether the movement of the bucket 12 to the second, rollback position R is complete, based on the bucket angle data 128 from the sensors 68 for example. If the movement of the bucket 12 is complete, the method ends at 512. Otherwise, the method loops to 504.

Figure 9B:
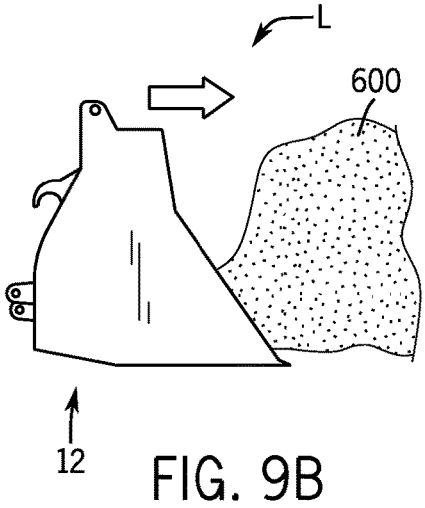
Figure 9C:
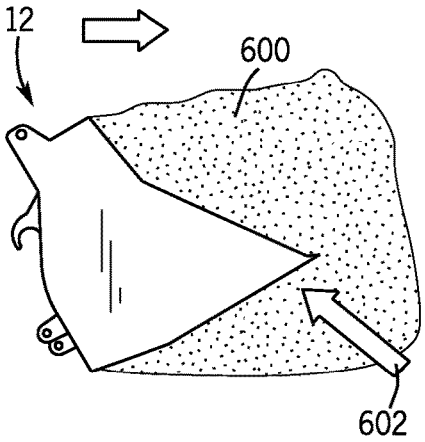
Figure 9D:
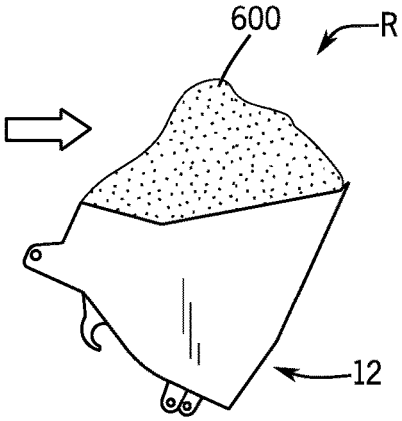

With continued reference to FIGS. 1-4, and with additional reference to FIGS. 9A-9D, the rollback control system and method is illustrated as implemented to move the bucket 12 from the first, load position L (FIGS. 9A and 9B) to the second, rollback position R (FIG. 9D). For clarity, only the bucket 12 is illustrated in FIGS. 9A-9D, with the understanding that the entirety of the loader 10 is employed to move the bucket 12, as discussed previously herein. With reference to FIG. 9A, the bucket 12 is illustrated as positioned adjacent to material 600. Upon receipt of input data 112, which includes the command 114 for the assisted movement of the bucket 12 during a load operation, the controller 48 determines whether to enable the rollback event based on the angle sensor data 124.

Once the controller 48 determines to enable the rollback event (e.g. rollback event enable 130), the controller 48 determines whether the bucket 12 is positioned in the material 600 (e.g. true entry value 226), as illustrated in FIG. 9B. Based on the vehicle data 224 and boom acceleration data 136, the controller 48 determines or retrieves the entry value 226. If the entry value 226 is true, the method retrieves the movement value 140 based on the angle sensor data 124 and optionally based on the material type 116. Based on the retrieved movement value 140, with reference to FIG. 9C, the controller 48 generates or outputs the one or more control signals for the pumps 52 and/or control valves 54 to actuate the hydraulic cylinders 34, 36 to move the bucket 12 to the second, rollback position R of FIG. 9D. As illustrated in FIG. 9C, an inertia force 602 may assist in moving the bucket 12 towards the second, rollback position R and may further assist in ensuring the bucket 12 is loaded with the material 600. The pressure the inertia force 602 exerts on the bucket 12, and thus, the hydraulic circuit, including the hydraulic cylinders 28, 34, 36 may be monitored by the controller 48 using the control method 500 of FIG. 8. With reference to FIG. 9D, FIG. 9D illustrates the completed movement of the bucket 12 into the second, rollback position R in which the bucket 12 is loaded with the material 600. Thus, the rollback control system and method of the present disclosure allows for more efficient operation of the loader 10 by ensuring the bucket 12 is substantially completely loaded with the material 600.

As will be appreciated by one skilled in the art, certain aspects of the disclosed subject matter can be embodied as a method, system (e.g., a work vehicle control system included in a work vehicle), or computer program product. Accordingly, certain embodiments can be implemented entirely as hardware, entirely as software (including firmware, resident software, micro-code, etc.) or as a combination of software and hardware (and other) aspects. Furthermore, certain embodiments can take the form of a computer program product on a computer-usable storage medium having computer-usable program code embodied in the medium.

Any suitable computer usable or computer readable medium can be utilized. The computer usable medium can be a computer readable signal medium or a computer readable storage medium. A computer-usable, or computer-readable, storage medium (including a storage device associated with a computing device or client electronic device) can be, for example, but is not limited to, an electronic, magnetic, optical, electromagnetic, infrared, or semiconductor system, apparatus, or device, or any suitable combination of the foregoing. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device. In the context of this document, a computer-usable, or computer-readable, storage medium can be any tangible medium that can contain, or store a program for use by or in connection with the instruction execution system, apparatus, or device.

A computer readable signal medium can include a propagated data signal with computer readable program code embodied therein, for example, in baseband or as part of a carrier wave. Such a propagated signal can take any of a variety of forms, including, but not limited to, electromagnetic, optical, or any suitable combination thereof. A computer readable signal medium can be non-transitory and can be any computer readable medium that is not a computer readable storage medium and that can communicate, propagate, or transport a program for use by or in connection with an instruction execution system, apparatus, or device.

Aspects of certain embodiments are described herein can be described with reference to flowchart illustrations and/or block diagrams of methods, apparatus (systems) and computer program products according to embodiments of the disclosure. It will be understood that each block of any such flowchart illustrations and/or block diagrams, and combinations of blocks in such flowchart illustrations and/or block diagrams, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions can also be stored in a computer-readable memory that can direct a computer or other programmable data processing apparatus to function in a particular manner, such that the instructions stored in the computer-readable memory produce an article of manufacture including instructions which implement the function/act specified in the flowchart and/or block diagram block or blocks.

The computer program instructions can also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Any flowchart and block diagrams in the figures, or similar discussion above, can illustrate the architecture, functionality, and operation of possible implementations of systems, methods and computer program products according to various embodiments of the present disclosure. In this regard, each block in the flowchart or block diagrams can represent a module, segment, or portion of code, which includes one or more executable instructions for implementing the specified logical function(s). It should also be noted that, in some alternative implementations, the functions noted in the block (or otherwise described herein) can occur out of the order noted in the figures. For example, two blocks shown in succession (or two operations described in succession) can, in fact, be executed substantially concurrently, or the blocks (or operations) can sometimes be executed in the reverse order, depending upon the functionality involved. It will also be noted that each block of any block diagram and/or flowchart illustration, and combinations of blocks in any block diagrams and/or flowchart illustrations, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A rollback control system for a work vehicle having a bucket positioned by a boom assembly, the bucket movable between a first position in which the bucket is positioned within a load material and a second position in which the bucket is in a rollback position, the boom assembly moving the bucket by one or more hydraulic cylinders of a hydraulic circuit, the rollback control system comprising:

a source of vehicle conditions data that indicates one or more observable conditions associated with the work vehicle; and at least one controller that receives and processes the vehicle conditions data to determine a position of the bucket relative to the material;

wherein the control system initiates a rollback event in which the at least one controller outputs one or more control signals to direct flow of hydraulic fluid to the hydraulic cylinders to move the bucket to the second position according to a determination that the bucket has been in the first position based on the vehicle conditions data indicating that material is loaded in the bucket and a determination that the bucket is moving from the first position toward the second position as indicated by the vehicle conditions data;

whereby the control system initiates the rollback event while inertia of at least one of the work vehicle and the material contributes to loading the bucket with material.

2. The rollback control system of claim 1, further comprising a pressure sensor that indicates a pressure associated with the hydraulic circuit and the at least one controller determines the position of the bucket based on the pressure.

3. The rollback control system of claim 1, further comprising a source of acceleration data associated with the boom assembly and the at least one controller determines the position of the bucket based on the acceleration data.

4. The rollback control system of claim 1, wherein the source of vehicle conditions data includes a wheel speed sensor that indicates a speed associated with one or more wheels of the work vehicle and the at least one controller determines the position of the bucket based on the speed associated with the one or more wheels.

5. The rollback control system of claim 1, wherein the source of vehicle conditions data includes an engine speed sensor that indicates a speed of an engine of the work vehicle, and the at least one controller determines the position of the bucket based on the speed of the engine.

6. The rollback control system of claim 1, further comprising:

a source of input data that indicates a type of the material for loading the bucket;

wherein the at least one controller outputs the one or more control signals based on the type of the material.

7. The rollback control system of claim 1, further comprising:

a boom position sensor that indicates a position of the boom assembly relative to a frame of the work vehicle;

wherein the at least one controller outputs the one or more control signals based on the position of the boom assembly.

8. The rollback control system of claim 1, further comprising:

a boom position sensor that indicates a position of the boom assembly relative to a frame of the work vehicle; and a bucket position sensor that indicates a position of the bucket relative to the boom assembly;

wherein the at least one controller determines whether to initiate the rollback event in part based on the sensed position of the boom assembly and the sensed position of the bucket.

9. The rollback control system of claim 1, wherein the at least one controller outputs one or more control signals to control a speed of an engine of the work vehicle based on the determined position of the bucket.

10. The rollback control system of claim 1, wherein the at least one controller outputs one or more control signals to control a range of a transmission of the work vehicle based on the determined position of the bucket.

11. A rollback control method for a work vehicle having a bucket positioned by a boom assembly, the bucket movable between a first position in which the bucket is positioned within a load material and a second position in which the bucket is in a rollback position, the boom assembly moving the bucket by hydraulic cylinders of a hydraulic circuit to load the bucket with material, the rollback control method comprising:

receiving vehicle conditions data associated with one or more observable conditions of the work vehicle;

processing the vehicle conditions data by at least one controller to determine a position of the bucket relative to the material; and initiating a rollback event by outputting one or more control signals with the at least one controller to direct flow of hydraulic fluid to the hydraulic cylinders to move the bucket to the second position according to a determination that the bucket has been in the first position based on the vehicle conditions data indicating that material is loaded in the bucket and a determination that the bucket is moving from the first position toward the second position as indicated by the vehicle conditions data;

whereby the rollback event is initiated while inertia of at least one of the work vehicle and the material contributes to loading the bucket with material.

12. The method of claim 11, wherein receiving the vehicle conditions data associated with the one or more observable conditions of the work vehicle further includes:

receiving at least one of a speed of the work vehicle from a vehicle speed sensor, a speed of one or more wheels of the work vehicle from a wheel speed sensor, a speed of an engine of the work vehicle from an engine speed sensor and an acceleration of the work vehicle from a vehicle acceleration sensor.

13. The method of claim 11, further comprising:

receiving an acceleration of the boom assembly near the bucket from a boom acceleration sensor; and determining the position of the bucket relative to the material based on the acceleration of the boom assembly.

14. The method of claim 11, further comprising:

receiving input data including a type of the material for loading the bucket; and outputting the one or more control signals with the at least one controller based on the type of the material.

15. The method of claim 11, further comprising:

receiving a pressure associated with the hydraulic circuit from a pressure sensor; and determining the position of the bucket relative to the material based on the pressure.

16. A rollback control system for a work vehicle having a bucket positioned by a boom assembly, the bucket movable between a first position in which the bucket is positioned within a load material and a second position in which the bucket is in a rollback position, the boom assembly moving the bucket by hydraulic cylinders of a hydraulic circuit, the rollback control system comprising:

a source of pressure data that indicates a pressure associated with the hydraulic circuit;

a source of acceleration data associated with the boom assembly; and at least one controller that receives and processes the pressure data and the acceleration data to determine a position of the bucket relative to the material;

wherein the control system initiates a rollback event in which the at least one controller outputs one or more control signals to direct flow of hydraulic fluid to the hydraulic cylinders to move the bucket to the second position according to a determination that the bucket has been in the first position and a determination that the bucket is moving toward the second position, as indicated by at least one of the pressure and acceleration data;

whereby the control system initiates the rollback event while inertia of at least one of the work vehicle and the material contributes to loading the bucket with material.

17. The rollback control system of claim 16, further comprising:

a source of vehicle conditions data that indicates one or more observable conditions associated with the work vehicle, wherein the at least one controller receives and processes the vehicle conditions data to determine the position of the bucket relative to the material.

18. The rollback control system of claim 17, wherein the source of vehicle conditions data includes an engine speed sensor that indicates a speed of an engine of the work vehicle, and the at least one controller determines the position of the bucket based on the speed of the engine.

19. The rollback control system of claim 17, wherein the source of vehicle conditions data includes a wheel speed sensor that indicates a speed associated with one or more wheels of the work vehicle and the at least one controller determines the position of the bucket based on the speed associated with the one or more wheels.

* * * * *